United States Patent [19]

Nelson

[11] Patent Number: 4,761,921

[45] Date of Patent: Aug. 9, 1988

[54] SOUND-MASKING SYSTEM FOR CORE MODULES USED IN AN OFFICE

[76] Inventor: Philip H. Nelson, 42 Harmony Rd., Spring Valley, N.Y. 10977

[21] Appl. No.: 4,126

[22] Filed: Jan. 16, 1987

[51] Int. Cl.[4] ..... E04B 1/82

[52] U.S. Cl. ..... 52/33; 52/173 R; 52/239; 181/287

[58] Field of Search ..... 52/239, 27, 33, 36, 52/173; 312/7.1, 194; 181/199, 287–286; 381/73.1

[56] References Cited

U.S. PATENT DOCUMENTS

| | | | |
|---|---|---|---|
| 3,418,765 | 12/1968 | Propst | 52/36 |
| 3,742,932 | 7/1973 | Greerspan | 52/33 |
| 3,945,132 | 3/1976 | Parmelee | 52/36 |
| 3,993,345 | 11/1976 | Croup | 181/199 |
| 4,006,311 | 2/1977 | Carlsson | 181/199 |
| 4,052,564 | 10/1977 | Propst | 312/7.1 |
| 4,185,167 | 1/1980 | Cunningham | 381/73.1 |
| 4,185,422 | 1/1980 | Rudek | 52/36 |
| 4,219,101 | 8/1980 | Valsvilla | 181/287 |
| 4,280,019 | 7/1981 | Propst | 381/73.1 |

FOREIGN PATENT DOCUMENTS

| | | | |
|---|---|---|---|
| 2450628 | 11/1975 | Fed. Rep. of Germany | 52/239 |
| 9036 | of 1903 | United Kingdom | 52/36 |

*Primary Examiner*—Henry E. Raduazo

*Attorney, Agent, or Firm*—Ralph R. Roberts; Patrick J. Pinto

[57] ABSTRACT

An acoustic sound-masking system carried in a core module provides conversational privacy for workers in an open-plan office space. The core module is movable to a desired location on the open floor and has at least three substantially like height side-panel portions providing a movable tubular enclosure. This module has a top member configured to provide a closure of the top end of the tubular enclosure and at least one through aperture is formed and in which is mounted a loudspeaker. This loudspeaker is adapted to produce sound and direct this sound upwardly and outwardly. Each loudspeaker is mounted so as to not protrude excessively above the top surface of the top member. At least one divider is attached or has one end substantially contiguous to the tubular enclosure. A plurality of desks or work areas is arrayed between the dividers, with a pair of desks or work areas between each divider. Each work area is adapted to be within that area proximate a divider, with the sound-masking level great enough to insure speech privacy for the occupant of said work area, while providing sound-masking only for this localized area.

10 Claims, 2 Drawing Sheets

SOUND-MASKING SYSTEM FOR CORE MODULES USED IN AN OFFICE

BACKGROUND OF THE INVENTION

1. Field of the Invention

The field of this invention, as established in and by the U.S. Patent and Trademark Office, is believed to be found in the general class entitled "Static Structures," and in the sub-class entitled "with exposed configuration having acoustical function." Sound-masking having a particular mounting to provide a desired result is believed to be very fragmented in the art.

2. Description of the Prior Art

The concept of a cluster core with sound-masking speakers mounted in and directing the masking sound upward is not shown in the known art. Sound-masking, although well known, is often referred to as "white noise." Random sound at a low level is often desirable in an office where conversations over the phone or to an associate are desired to be confidential. In a pre-Ex search, the following U.S. patents were noted: U.S. Pat. No. 3,567,863 to MORRISSEY as issued Mar. 2, 1971; U.S. Pat. No. 4,010,324 to JARVIS et al as issued Mar. 1, 1977; U.S. Pat. No. 4,052,564 to PROPST et al as issued Oct. 4, 1977; U.S. Pat. No. 4,054,751 to CALDER et al as issued Oct. 18, 1977; U.S. Pat. No. 4,280,019 as issued July 21, 1981 to PROPST et al, and U.S. Pat. No. 4,438,526 as issued to THOMALLA on Mar. 20, 1984.

Other U.S. patents include U.S. Pat. No. 3,980,827 as issued to SEPMEYER et al on Sept. 14, 1976. U.S. Pat. No. 3,980,827 shows a multiplicity of speakers carried in a desired array in a ceiling of the office room. Applicant's concept of supplying of the sound-masking in a cluster core module uses this core to provide the needed support. U.S. Pat. No. 3,985,957 issued to TORN on Oct. 12, 1976. This TORN patent suspends a speaker so that the sound waves are transmitted downwardly through an acoustic ceiling. This ceiling is special and the speaker (or speakers) is in a plenum space above the acoustic ceiling. Also noted was U.S. Pat. No. 4,024,535 as issued to GOLDSTEIN on May 17, 1977. This patent shows soundmasking wherein a speaker is mounted in a round enclosure. The package includes not only the speaker, but wiring and a circuit board wtihin the housing. Lug connectors that extend beyond the enclosure are caused to carry signals and power from package to package. Also of particular note is U.S. Pat. No. 4,059,726 to WATTERS et al as issued Nov. 22, 1977. Although the desks, chairs and partitions are shown in many configurations, the core module concept is not shown and the carrying of speakers on and by the top closure board is not shown or suggested. As in prior devices, the speakers are mounted in that space between a ceiling and a false ceiling with acoustical ceiling portions.

The references noted above do not show or suggest placing in a core module sound-masking apparatus which is contained in this module and is movable with said module. The needed apparatus is contained within the enclosure except for needed electrical connecting wires. As to be described later in detail, this module is adapted for open office space wherein the positioning of desks and work areas may be and is changed to accommodate expanded or contracted requirements.

SUMMARY OF THE INVENTION

This invention may be summarized, at least in part, with reference to its objects. It is an object of this invention to provide, and it does provide, a new and novel support enclosure in a core module for an open-plan office wherein sound-masking is carried in said core module and is proximate to those whose desk or work area is sufficiently close to utilize the sound-masking.

Another object of this invention is to provide, and it does provide, sound-masking apparatus that is self-contained within a core module and provides sufficient sound-masking that conditions the human ear of those within said area to reject unwanted sound. Mounted in the core module, this sound-producing apparatus is inconspicuous, easily moved as the module is moved, and with this apparatus relatively inexpensive.

In brief, this sound-masking apparatus is mounted in a core module so that a speaker (or speakers) is carried in the top closure member, with the speaker sound directed upward and outward. Within the core module are secured the electronics creating the sound generation and essential electrical components are concealed. The module may be configured for as few as two desks and/or compartments, or as many as eight or more. Each module is designed to be self-contained, with the speakers adapted to produce the desired level of sound.

In addition to the above summary, the following disclosure is detailed to insure adequacy and aid in understanding of the invention. This disclosure, however, is not intended to cover each new inventive concept no matter how it may later be disguised by variations in form or additions of further improvements. For this reason, there have been chosen specific embodiments of sound-masking systems for core modules as used in office and like areas. These core modules and the sound-masking system therein are as adopted for selective positioning and removal to another area and showing a preferred means for construction of said modules and the sound generation therein. These specific embodiments have been chosen for the purposes of illustration and description as shown in the accompanying drawings wherein:

BRIEF DESCRIPTION OF THE DRAWINGS

In the following description and in the claims, various details are identified by specific names for convenience. These names are intended to be generic in their application. Corresponding reference characters refer to like members throughout the several figures of the drawings.

The drawings accompanying, and forming part of, this specification disclose details of construction for the purpose of explanation, but structural details may be modified without departure from the concept and principles of the invention and the invention may be incorporated in other structural forms than shown.

EMBODIMENT OF FIGS. 1, 2 AND 3

Figure 1:
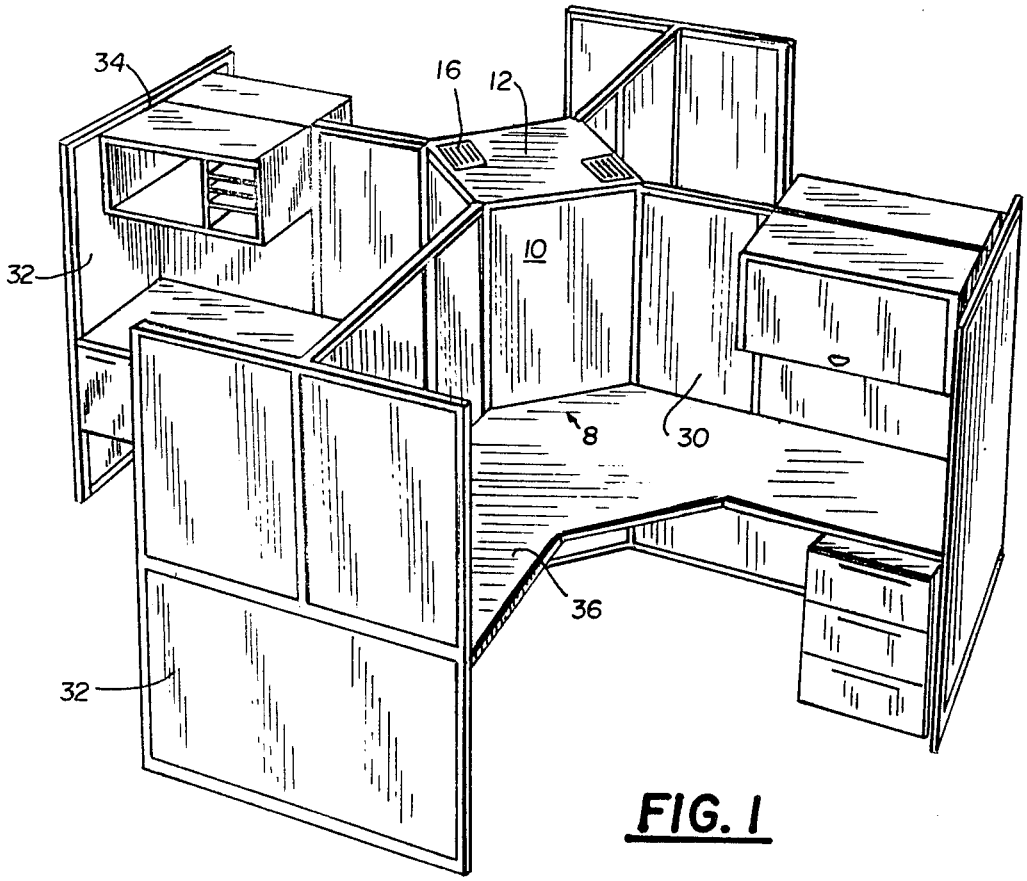
FIG. 1 represents an isometric view showing a sound-masking core module for a four-compartment array.
Figure 3:
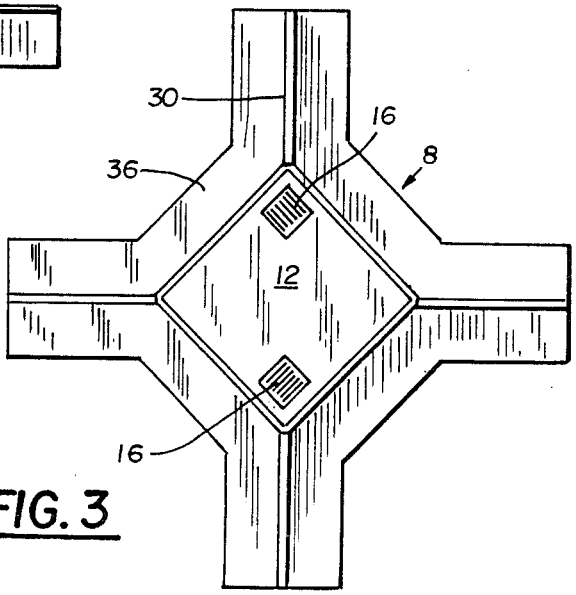
FIG. 3 represents a plan view of the sound-masking core module of FIG. 1 and displaying a modified arrangement.
Figure 2:
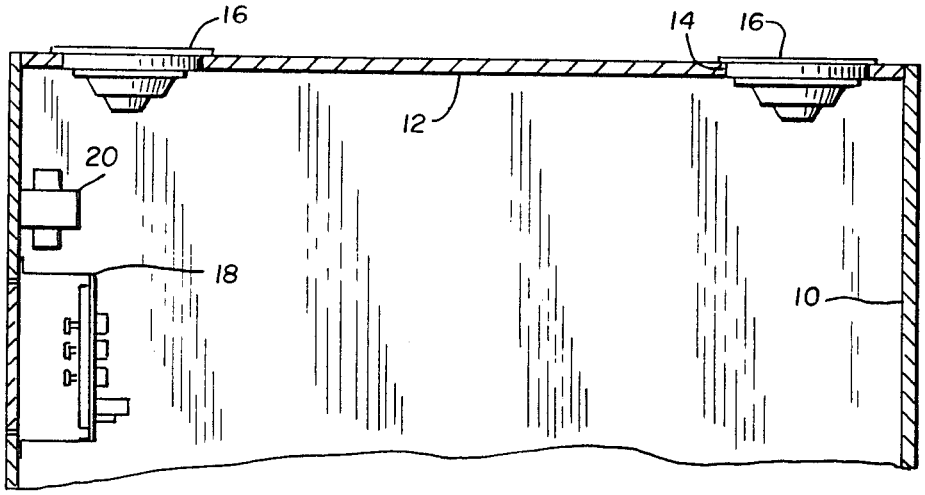
FIG. 2 represents a sectional side view of a typical sound-masking core module and illustrating a securing arrangement.

Referring next to the drawings and, in particular, to FIGS. 1, 2 and 3 thereof, the sound-masking system used in a core module 8 is depicted to illustrate the novel concept. In FIG. 1, the system includes a tubular center portion having panels 10 which are shown as generally square. For sound damping, these modules are generally of wood or like material. A top member 12 is secured to the side panel portions 10 to make the core module vibration-resistant or -free. In this top member 12 are formed one or more openings 14, in each of which is mounted a speaker 16. These speakers are mounted so that protrusion is minimal. These speakers may be round, rectangular, or any selected shape, and are adapted to direct the produced sound upwardly and also toward the immediate side areas as provided in any wide-angled speaker. Within the module is a P.C. board 18 (FIG. 2) or the like to provide the circuit for the sound-masking. Also shown in this view is a transformer 20 conventionally used in such systems. The P.C. board 18 is shown as secured to a side panel portion 10, but may be secured to the top member 12 as interior placement is a matter of convenience. Not shown is the wiring between components, speakers, and an "on" and "off" switch and/or volume control, which are conventionally supplied with such systems.

Referring again to FIG. 1, the core module 8 is depicted as a central portion of four-compartment work areas. This module is shown with wall divider portions 30 and end portions 32. Suggested additions are storage compartments 34 and shelf or desk surface members 36. The module 8 is closed at the top, but is usually open at the bottom so that electrical wiring may be fed to the interior of the module and if the P.C. board circuit is used to drive other speakers in other modules to provide wiring connectors. This assembly is adapted to be moved within an open area to accommodate the desired placement of personnel.

The plan view of FIG. 3 illustrates the module assembly of FIG. 1, but without end portions 34. This plan view shows top plate or member 12 with a pair of speakers 16 mounted therein. The divider portions 30 are four in number and between these dividers are the desk or work areas 36, which are only illustrative, and no patentable distinction of this configuration should be or is intended as this is a matter of preference.

EMBODIMENT OF FIG. 4

Figure 4:
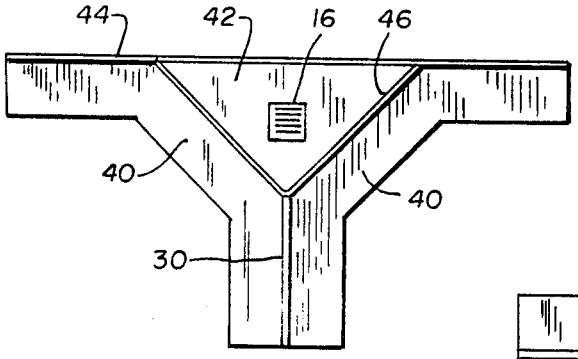
FIG. 4 represents a plan view of a sound-masking core module for two desks or work areas.

In FIG. 4, the core module is depicted for use with only two work areas, identified as 40. A speaker 16, as described above, is mounted in a triangular top plate 42. A partition member 30, as in FIG. 3, is disposed between the work areas. A rear closure member 44 is shown as providing a closure for the third side of vertical core members 46. It is noted that only one speaker 16 is shown as the arrangement is usually against a wall.

EMBODIMENT OF FIG. 5

Figure 5:
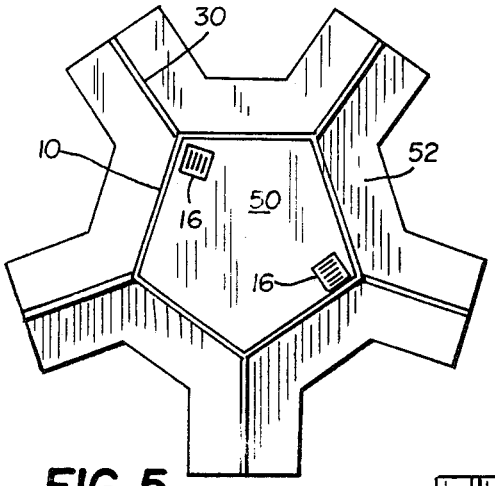
FIG. 5 represents a plan view of a sound-masking core module for five desks or work areas.

In FIG. 5, a module arrangement much like that shown in FIG. 4 is depicted. Rather than the triangular top 42 of FIG. 3 or the square (four-sided) top member 12 of FIG. 4, this top member is five-sided and is identified as 50. Two speakers 16 are mounted in this top member and, as shown, are substantially parallel to an adjacent panel portion 10. A desk or work-surface area (five in all), identified as 52, is configured to accommodate this five-sided module concept.

EMBODIMENT OF FIG. 6

Figure 6:
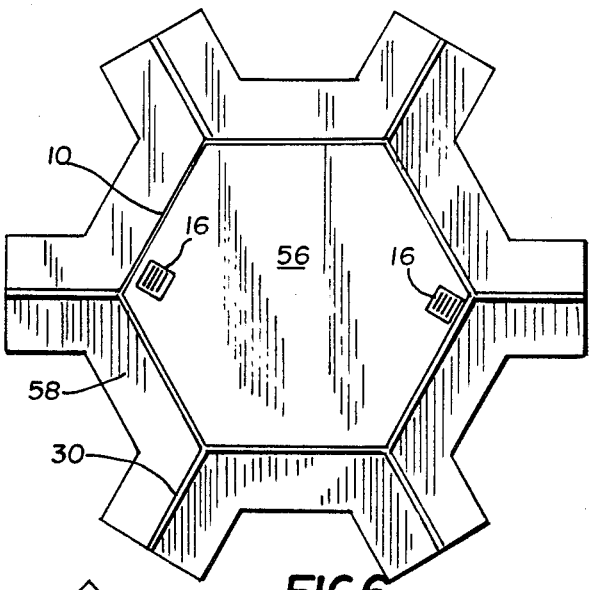
FIG. 6 represents a plan view of a sound-masking core module for six desks or work areas.

In FIG. 6, a module arrangement very similar to the arrangement of FIG. 5 depicts a six-sided array. This arrangement utilizes a top member, identified as 56, in which are mounted two speakers 16. This top member 56 is secured to six like panel portions 10. There are six panel-portions 30 which are separators of this work area. As shown, there is a desk surface or work area 58 between each panel portion requiring six.

EMBODIMENT OF FIG. 7

Figure 7:
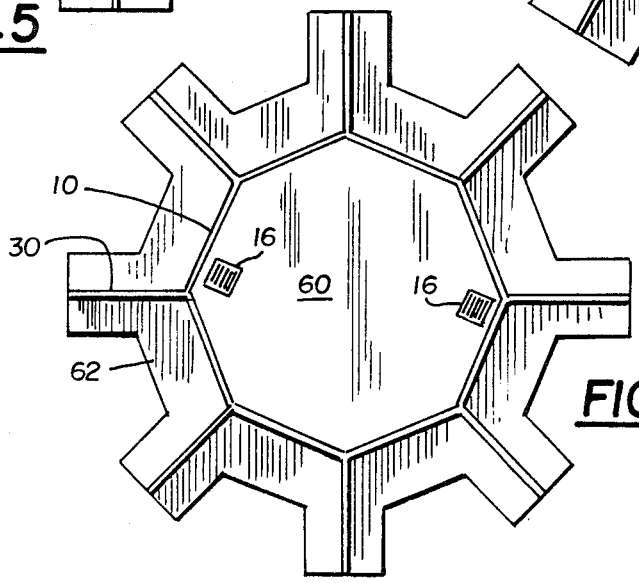
FIG. 7 represents a plan view of a sound-masking core module for eight desks or work areas.

In FIG. 7, a module arrangement, very similar to that of FIG. 6, shows an octagonal arrangement in which the top member, identified as 60, is made with eight support edges. Panels 10 may be the same width as in prior showings, or less in extent as desired. A pair of speakers 16 is mounted in this top member 60. Dividers 30 are like or similar to those described above and define a separation of work areas. Also depicted are eight desk or work areas 62. The configuration of the desk portions is a matter of design. Octagonal arrangements are likely the maximum number for partitions and desks, but this does not preclude a module of more than eight.

In the above embodiments, it is indicated that the speakers 16 are in close proximity to the work areas of the personnel assigned thereto. With the increased cost of desks, office space and the like, the core module concept makes economical sense. The speakers 16 used are unobtrusive and the module and panels 30 are usually of about six feet or less so as to provide the concept of an open work area. Sound-masking is very desirable in the presence of such working conditions. The placement of the speakers 16 in a top member is a matter of selection, but symmetry is usually considered. Whether storage compartments 34 or other associated accessories, such as drawers, are provided is merely a matter of choice.

As noted above, the prior art devices require interconnection of electronic systems and generation of loudspeaker amplification. The self-contained and protected enclosure of the systems requires only electronic wires or electrical AC supply which is readily available. Prior systems, when one component fails, may cause a total failure of the entire system, but this is not a problem in the core module system described above. Small changes in the output level of the loudspeakers serving a module are easily achieved by a variable resistor. A switch means to turn the systems "on" and "off" is also contemplated and conventional. The unitary nature and constructional and mounting features of the core modules depicted above admirably provide optional superposition of sound-masking and insure significant improvement in speech privacy in the working area of the open space. The separate partitioned areas have sound-masking tailored to the requirements of those who are the usual occupants.

As a practical matter, the work areas may include the support surfaces 36 which are contemplated to be integrally constructed to not only provide a work space for an employee, but also to provide support means for the divider 30. This is not to preclude the use of desks instead of the work area members 36. It is also noted that said apertures 14 are each contemplated to retain a loudspeaker 16, but this does not preclude additional apertures absent a loudspeaker. It is also contemplated that this soundmasking system may be actuated by voice signals in which actuation is now available in phone-answering systems in the like.

Terms such as "left," "right," "up," "down," "bottom," "top," "front," "back" and the like are applicable to the embodiments shown and described in conjunction with the drawings. These terms are merely for the purpose of description and do not necessarily apply to the position in which the loudspeakers of and in the core module providing the sound-masking may be constructed or used.

While particular embodiments of the core module have been shown and described, it is to be understood that the invention is not limited thereto and protection is sought to the broadest extent the prior art allows.

What is claimed is:

1. An acoustic sound-masking system carried in a core module assembly, said sound- masking conditioning the human ear of those within an area to reject unwanted sound and providing conversational privacy and individual work-areas for workers in an open-plan office space, this and each core module assembly movable to a desired location within the open-plan office space and on the open floor, this sound-masking system including:

(a) a core module assembly having at least three sidepanel portions and a flat top portion, each sidepanel portion substantially alike in height, and with said panels secured to provide an assembly which is an enclosure movable, without disassembly, on said floor;

(b) the flat top panel configured to provide a closure of and for the top portion of the enclosure,and means for securing this top panel to each side of the side panel portions;

(c) at least one through aperature formed in said top panel, said at least one through aperature having a selected and determined configuration;

(d) a loudspeaker mounted in each of said through aperture with said loudspeaker adapted to produce a sound-masking or random-noise sound at a low level and direct said sound-masking noise upwardly and outwardly, each loudspeaker mounted so as to not protrude obtrusively and excessively above the top surface of the top panel;

(e) at least one divider for each side panel and having at a first end operatively attached to said enclosure at the intersection of said side panels, and (f) a plurality of desks or individual work-areas arrayed between two of said at least one divider and adjacent the side panel,with a divider between each pair of desks or individual work-areas, and with a desk or work-area adjacent each side extent of a divider, said work-area adapted to be within that area proximate to a divider, the sound-masking noise level great enough to insure speech privacy for the occupant of said work, these work areas and said loudspeaker, producing said random-sound noise, providing sound-masking for this localized area.

2. An acoustic sound-masking system as in claim 1 in which the movable enclosure is triangular and there are two work areas with a divider therebetween, and there is one loudspeaker mounted in an aperture in the top member.

3. An acoustic sound-masking system as in claim 1 in which the movable member is rectangular and there are four work areas with a divider between each work area, and there is a pair of loudspeakers mounted in formed apertures in the top member.

4. An acoustic sound-masking system as in claim 1 in which at each exterior end of a divider there is also provided an end portion.

5. An acoustic sound-masking system as in claim 1 in which a work area also includes additional accessories such as storage shelves and/or drawers.

6. An acoustic sound-masking system as in claim 1 in which the electronic circuit providing the sound masking includes a P.C. board carried by and attached to a panel portion of the movable tubular portion.

7. An acoustic sound-masking system as in claim 1 in which the top member is configured to just fit into the movable tubular member to provide a support for said panel portions, and the attachment of said panel portions to the top member is provided by nails, screws and the like.

8. An acoustic sound-masking system as in claim 1 and providing mounting means in each side panel and side extent of said dividers for additional accessories such as desks, storage shelves drawers and the like.

9. An acoustic sound-masking system as in claim 1 in which an end panel is operatively attached to a second end of each divider and at more or less ninety degrees and providing a greater conversational privacy.

10. An acoustic sound-masking system as in claim 1 in which the side panels and dividers are of equal height of approximately 6 feet.

* * * * *